US005203467A

United States Patent [19]

Tucker

[11] Patent Number: 5,203,467

[45] Date of Patent: * Apr. 20, 1993

[54] PROTECTIVE CAP WITH SEAL FOR BEVERAGE CONTAINER

[76] Inventor: Terence Tucker, P.O. Box 1420, San Juan Capistrano, Calif. 92693

[ * ] Notice: The portion of the term of this patent subsequent to Oct. 8, 2008 has been disclaimed.

[21] Appl. No.: 704,944

[22] Filed: May 23, 1991

Related U.S. Application Data

[63] Continuation-in-part of Ser. No. 598,175, Oct. 15, 1990, Pat. No. 5,054,640.

[51] Int. Cl.[5] ..... B65D 51/18

[52] U.S. Cl. ..... 220/254; 220/344; 220/713; 220/717

[58] Field of Search ..... 220/254, 306, 324, 344, 220/703, 711, 713, 716, 717; 215/237, 352

[56] References Cited

U.S. PATENT DOCUMENTS

| | | | |
|---|---|---|---|
| 110,148 | 12/1870 | Leach . | |
| D. 146,355 | 2/1947 | Guarnaschnelli | D58/26 |
| D. 200,820 | 4/1965 | Blakslee | D58/26 |
| D. 258,496 | 3/1981 | Ludwig, Jr. et al. | D9/439 |
| 1,463,892 | 8/1923 | Ingram et al. . | |
| 2,754,866 | 7/1956 | Coltman, Jr. . | |
| 2,764,199 | 9/1956 | Tupper | 220/254 |
| 2,764,200 | 9/1956 | Gits | 220/254 |
| 3,005,571 | 10/1961 | Hall | 220/324 |
| 3,085,710 | 4/1963 | McIlroy . | |
| 3,187,919 | 6/1965 | Inglis . | |
| 3,202,448 | 8/1965 | Stern et al. | 294/87.2 |
| 3,224,575 | 12/1965 | Whiteford . | |
| 3,250,564 | 5/1966 | Stern et al. | 294/87.2 |
| 3,281,180 | 10/1966 | Spery | 294/87.2 |
| 3,310,334 | 3/1967 | Murphy | 294/87.28 |
| 3,350,131 | 10/1967 | Tanzer | 294/87.2 |
| 3,362,572 | 1/1968 | Pelley . | |
| 3,372,832 | 3/1968 | Yeater et al. | 220/254 |
| 3,421,654 | 1/1969 | Hexel . | |
| 3,510,021 | 5/1970 | Silver . | |
| 3,583,591 | 6/1971 | Hayashida | 315/40 |
| 3,589,509 | 6/1971 | Mascia et al. . | |
| 3,601,439 | 8/1971 | Poupitch | 294/87.2 |
| 3,737,066 | 6/1973 | Ames | 220/254 |
| 3,744,655 | 7/1973 | Nixdorff, Jr. . | |
| 4,098,439 | 7/1978 | Blow, Jr. et al. | 222/531 |
| 4,361,250 | 11/1982 | Foster | 220/266 |
| 4,412,629 | 11/1983 | Dart et al. . | |
| 4,420,089 | 12/1983 | Walker et al. | 215/216 |
| 4,537,326 | 8/1985 | Morehead | 220/269 |
| 4,564,116 | 1/1986 | Prohaska | 215/256 |
| 4,721,222 | 1/1988 | Haythornthwaite | 220/234 |
| 4,790,444 | 12/1988 | Terzi . | |
| 4,796,774 | 1/1989 | Nabinger | 220/711 |
| 4,807,768 | 2/1989 | Gach | 215/216 |
| 4,838,441 | 6/1989 | Chernack | 215/216 |
| 4,869,389 | 9/1989 | Cerrone, Jr. | 220/713 |
| 4,874,103 | 10/1989 | Quisenberry et al. | 220/254 X |
| 4,883,192 | 11/1989 | Krugman . | |
| 4,938,379 | 7/1990 | Kellner | 220/713 X |
| 4,961,510 | 10/1990 | Dvoracek . | |
| 4,989,746 | 2/1991 | Pierce | 220/254 |
| 5,054,640 | 10/1991 | Tucker | 220/254 X |

*Primary Examiner*—Allan N. Shoap
*Assistant Examiner*—Nova Stucker
*Attorney, Agent, or Firm*—Stetina and Brunda

[57] ABSTRACT

A protective cap having a sealable cover for canned soft drinks and the like is disclosed. The cap comprises an outer periphery configured to receive and snap over a conventional beverage can such that a gas-tight seal is formed, a grate positioned to cover the opening in the top of the can through which the beverage may be consumed, and a hingeable cover having a seal which can be rotated between opened and closed positions to permit consumption of the beverage when in the open position and to seal the container when in the closed position. The sealing of the container prevents contamination of the enclosed beverage and seals in carbonation. It also prevents spillage if the container is overturned.

13 Claims, 3 Drawing Sheets

PROTECTIVE CAP WITH SEAL FOR BEVERAGE CONTAINER

RELATED APPLICATIONS

This application is a continuation in part of pending U.S. application Ser. No. 07/598,175, filed on Oct. 15, 1990, U.S. Pat. 5,054,640 hereby incorporated by reference.

FIELD OF THE INVENTION

The present invention relates generally to caps for beverage containers, and more particularly to a protective cap for canned soft drinks, beer, fruit juices, and the like which both prevents contamination of the beverage and seals in carbonation.

BACKGROUND OF THE INVENTION

Protective caps which prevent insects and other contamination from entering beverage containers while permitting consumption of the beverage contained therein are well known. A grating or similar set of apertures typically permits consumption of the beverage while preventing bees and other insects, lured by the sugar content of the beverage, from entering the container. Such prior art protective caps generally snap over the upper end of a soft drink container such that an opening defined by the grate is positioned directly over the opening in the container. Thus, the user can consume the beverage by drinking the liquid directly from the container through the protective cover.

The problem of insects, particularly bees, entering sugar-sweetened soft drinks and the like is common, particularly when such soft drinks are consumed outdoors. Besides being unappetizing and generally ruining the soft drink, such occurrences can be dangerous in that they may result in a bee sting or other insect bite or sting. In fact, there are cases where a bee sting inside the mouth or throat has caused death.

Caps for sealing carbonation within a soft drink contained within a can are likewise well known. Such caps typically fit directly within the opening of the soft drink container and are provided with a mechanism which permits them to clamp down and thus seal the opening in a gas-tight fashion.

The problem of leakage of carbonation from carbonated soft drinks and the like has long been recognized. This problem is often encountered when a portion of a soft drink is consumed and the remainder is then stored for consumption at a later time. Since the opened beverage can does not provide a gas-tight container, vapor pressure cannot build up within the can to prevent the boiling off of carbonic acid. This loss of carbonic acid from the soft drink results in a corresponding loss of the customary fizz due to lack of carbonation. Since it is desirable to retain the carbonation of an opened soft drink, it would be desirable to provide a means for doing so which also provides the user with the above-mentioned benefits in relation to a protective cap.

Another problem associated with the use of contemporary soft drink containers is spillage. Although a prior art carbonation seal prevents spillage if the container is accidently overturned, the prior art carbonation seal is simply too cumbersome to use during consumption. It would thus only provide spill protection during storage of an unconsumed portion of a beverage, i.e. when the carbonation seal is actually installed upon the container.

While such prior art protective covers do serve adequately to prevent bees and other large insects from entering the beverage container while permitting consumption of the beverage and such prior art carbonation seals do seal carbonation within the beverage, no single device is known which accomplishes both tasks. Additionally, the prior art protective covers are inadequate in preventing smaller insects, e.g., ants, mosquitoes and gnats, from entering the can. Furthermore, the prior art carbonation seals cannot be utilized without removing them from the container. It is desirable to provide a single protective cover which prevents both large and small insects from entering the container, which could be used to seal carbonation within the soft drink, which prevents spills, and which can also be used without removing the cap from the container.

SUMMARY OF THE INVENTION

The present invention specifically addresses and alleviates the above-mentioned deficiencies associated in the prior art. More particularly, a protective cap for soft drinks and the like is disclosed which comprises an outer periphery configured to receive and snap over a conventional beverage can and to provide a gas-tight seal thereto, a grate positioned to cover the opening in the top of the can through which the beverage may be consumed, and a hinged cover having a seal which can be manipulated between opened and closed positions to permit consumption of the beverage when in the open position and to seal the container when in the closed position. The grate prevents larger insects, such as bees, from entering the container. The hinged cover of the container both prevents contamination of the enclosed beverage by smaller insects and air-borne debris and also seals in carbonation. The hinged cover also prevents spills when in the closed position. A detent formed upon the distal end of the cover engages a complimentary detent formed upon the periphery of a planar surface which defines the cap to latch the cap in a closed position and thus insure a gas-tight seal. Alternatively, a detent formed upon the lower surface of the cover is received between adjacent bars of the grate to latch the cover in the closed position and thus assure a gas-tight seal.

In a first embodiment, disposing the hinged cover in the closed position compresses the seal and thus provides a gas-tight closure which retains the carbonation of the beverage contained therein. In a second embodiment, a substantially non-compressible seal is defined by complimentary ridges formed upon the cover and planar surface.

Since the hinged cover can be easily rotated between the opened and closed positions, it provides a convenient means for preventing spillage of the beverage in the event that the can is accidently overturned. The hinged cover can easily be rotated to the closed position after a drink is taken, and then returned to the open position when the next drink is desired.

These, as well as other advantages of the present invention will be more apparent from the following description and accompanying drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiments of the invention, and is not intended to represent the only form in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The protective cap of the present invention is illustrated in FIGS. 1–12 which depict two presently preferred embodiments of the invention. Referring now to FIGS. 1–8, a first embodiment of the present invention is illustrated.

Figure 1:
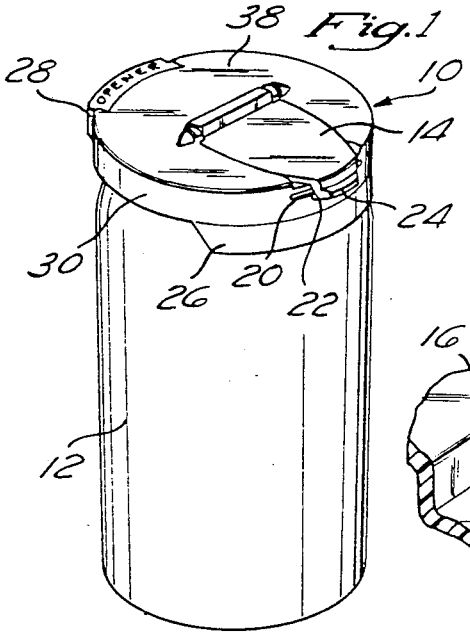
FIG 1 is a perspective view of the protective cap of the first embodiment of the present invention installed upon a beverage container.
Figure 2:
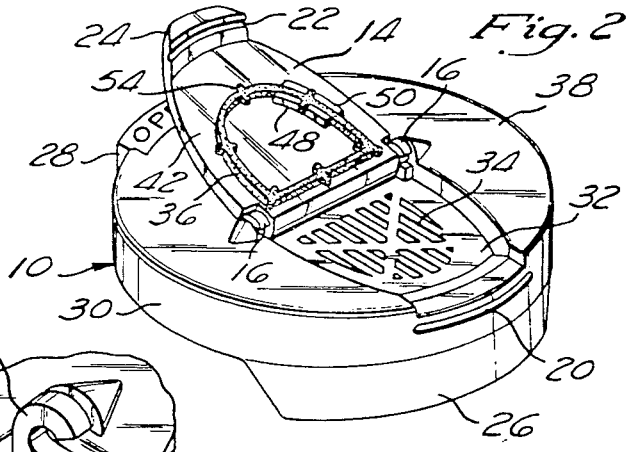
FIG. 2 is an enlarged perspective view of the protective cap of the present invention having the cover disposed in the open position.
Figure 3:
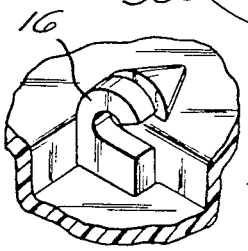
FIG. 3 is an enlarged sectional view of a socket for attaching the cover to the lid.
Figure 6:
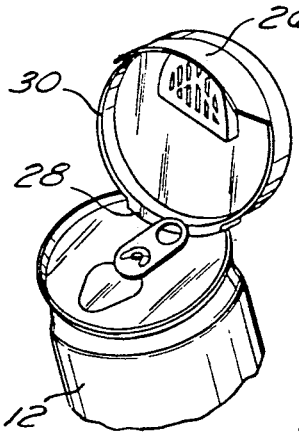
FIG. 6 is a perspective view of the protective cover of the present invention being used to effect the opening of a pop-top beverage container.
Figure 4:
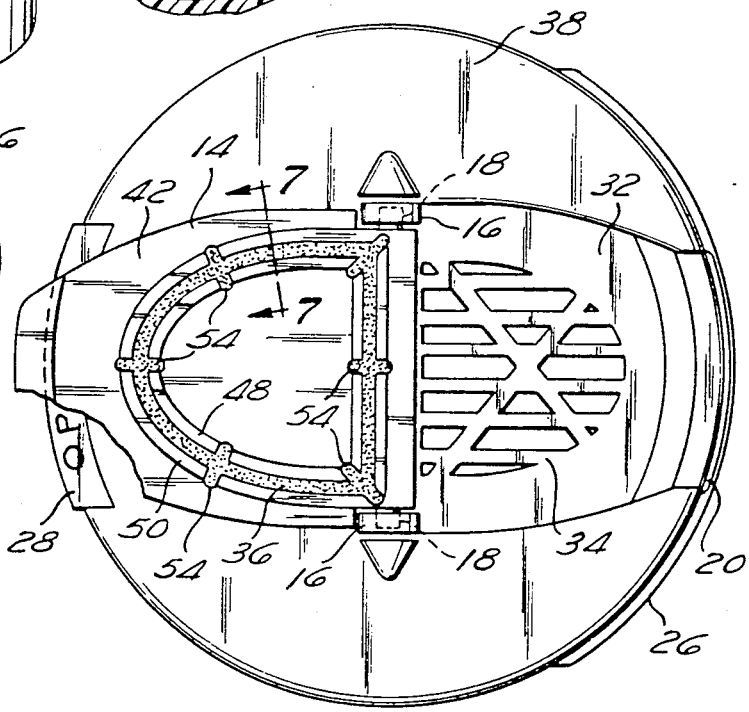
FIG. 4 is an enlarged top plan view of the protective cover of the present invention with the cover disposed in the open position.
Figure 5:
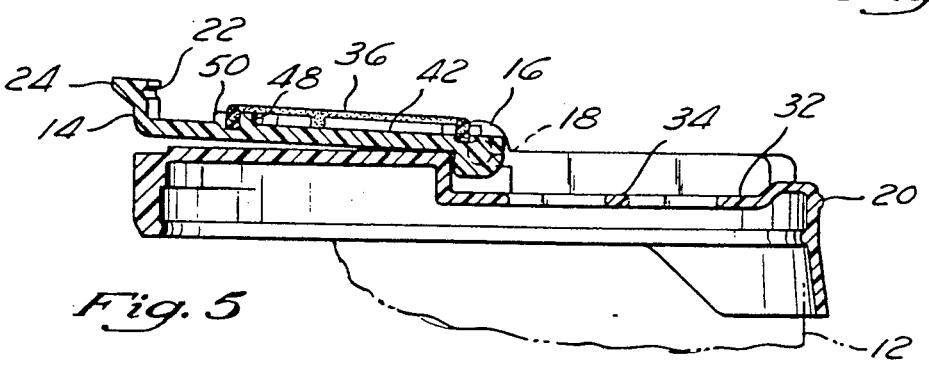
FIG. 5 is a cross-sectional side view of the protective cover of the present invention with the cover disposed in the open position.

With particular reference to FIG. 1, the protective cap 10 of the present invention is disposed upon a beverage container 12 and is generally comprised of a planar surface 38 and a hinged cover 14 attached thereto. A peripheral portion 30 surrounds the planar surface 38 and has a lip guard 26 formed thereupon. A first detent 20 formed upon the peripheral portion 30 of the planar substrate 38 engages and cooperates with a second detent 22 formed upon the distal end of the cover 14 to lock the cover 14 in the closed position. A tab 24 formed upon the distal end of the cover 14 facilitates opening of the cover 14. An opener 28 (best seen in FIGS. 2 and 6), comprising a reinforced section of the peripheral portion 30, is formed upon the planar surface 38 opposite the cover 14.

With particular reference to FIGS. 2–5, pivot pins 18 formed upon the proximal end of the cover 14 pivotally engage sockets 16 formed upon the planar surface 38 such that the cover 14 may be pivoted between opened and closed positions. A grate 34 is formed upon the planar surface 38 immediately below the hinged cover 14. A compressible seal 36 is disposed between generally parallel inner 48 and outer 50 ribs formed upon the underside 42 of the hinged cover 14. Transverse members 54 extend from the compressible seal 36 between adjacent inner 48 and outer 50 ribs. The transverse members 54 provide increased surface area for securing the compressible seal 36 in place. The seal 36 may be frictionally engaged with the ribs 48 and 50 or may be secured in place with an adhesive. The compressible seal 36 is preferably molded directly into a groove defined by the inner 48 and outer 50 ribs and may be comprised of a flexible plastic or rubber, such as those commonly used in O-ring seals. Those skilled in the art will recognize that various rubbers and flexible plastics are suitable for use as the compressible seal 50 of the present invention.

Figure 7:
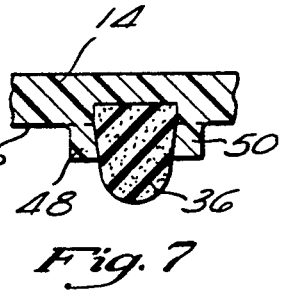
FIG. 7 is an enlarged cross-sectional view of the seal of FIGS. 2, 4, 5, and 8.

With particular reference to FIG. 7, the seal 36 extends a sufficient distance beyond the inner 48 and outer 50 ribs such that it may be compressed against the upper surface of the recess 32 (best shown in FIG. 4) to achieve a gas-tight seal.

Figure 8:
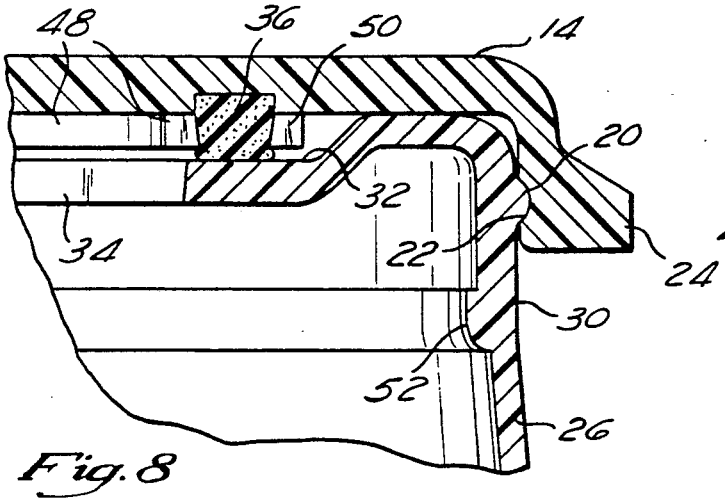
FIG. 8 is an enlarged cross-sectional view of the cap and cover illustrating compression of the seal when the cover is disposed in the closed position.

With particular reference to FIG. 8, closure of the cover 14 results in compression of the seal 36 such that a gas-tight fit is achieved. Additionally, the detent 52 formed about the inside of the peripheral portion 30 provides a gas-tight seal to a beverage container or can.

To use the protective cap 10 of the present invention, the user opens a can and then snap the cap onto the upper end thereof. The hinged cover 20 may remain in the opened position as long as there is no danger of the beverage becoming contaminated by small insects or air-borne debris. The hinged cover 20 is closed when the user encounters environments comprised of blowing dirt, sand, or the like, or when small insects are present. Alternatively, the user may dispose the hinged cover 20 in the closed position between drinks to prevent spills.

For example, when consuming a beverage out-of-doors, the user may dispose the hinged cover 20 in the closed position prior to setting the container upon the ground between drinks. This would prevent ants and other small insects from crawling into the container. It would also prevent spillage of the beverage if the container were accidentally overturned.

If the user decides not to finish the beverage, then the beverage may be stored within the container by disposing the cover 20 in the closed position to seal in carbonation. Thus, the beverage will not taste "flat" when consumed at a later time.

Figure 9:
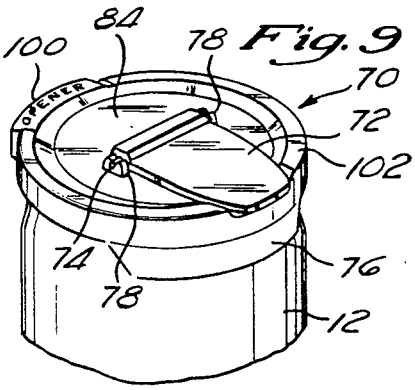
FIG. 9 is a perspective view of a second embodiment of the present invention showing the cap disposed upon a beverage container.

Referring now to FIGS. 9–12, a second embodiment of the protective cap of the present invention is illustrated. With particular reference to FIG. 9, the protective cap is comprised of a generally planar surface 84 and a cover 72 hingeably attached thereto. As in the first embodiment, an opener 100 is disposed at the periphery 102 of the planar surface 84, generally opposite the hinged cover 72. Pivot pins 74 formed upon the cover 72 engage sockets 78.

Figure 10:
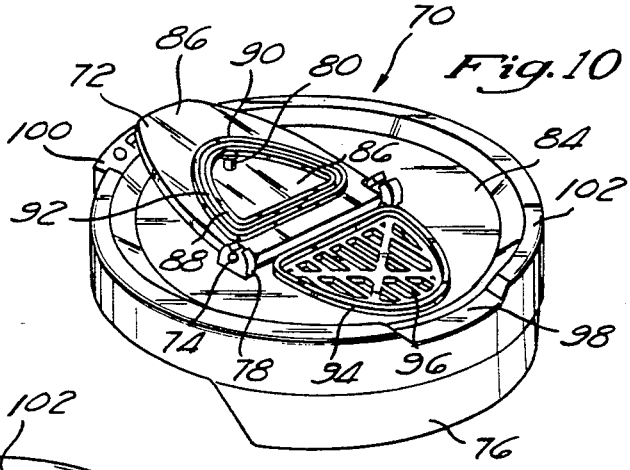
FIG. 10 is an enlarged perspective view of the protective cap of FIG. 9 showing the cover disposed in the open position.
Figure 11:
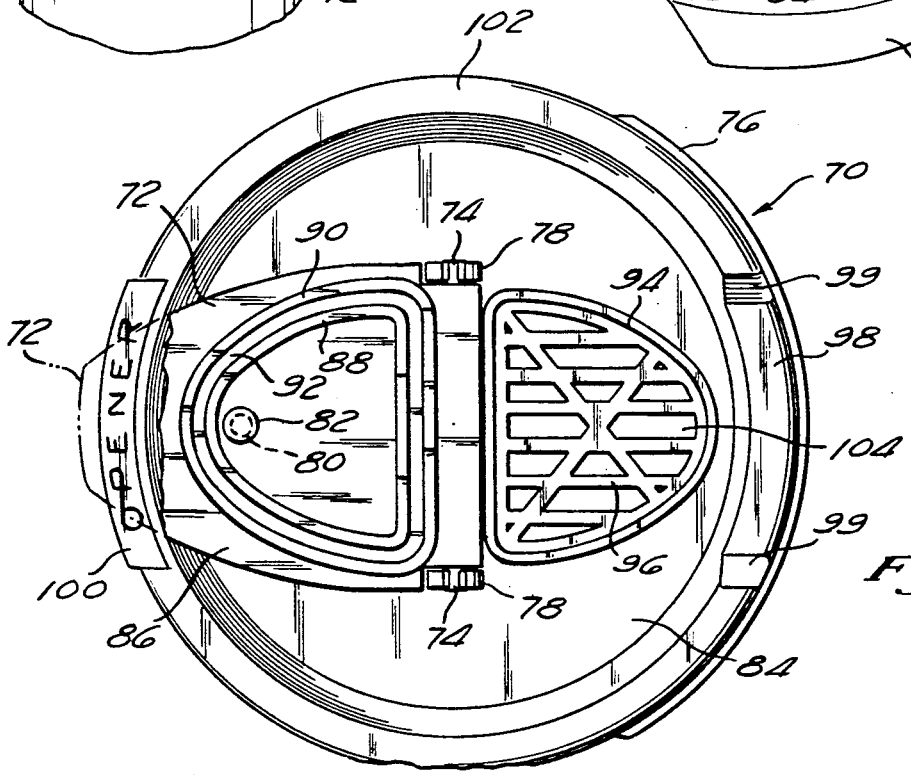
FIG. 11 is an enlarged plan view of the cap of FIG. 10 showing the cover disposed in the open position.

With particular reference to FIGS. 10 and 11, rigid inner 88 and outer 90 ribs are formed upon the underside 86 of the hinged cover 72. The rigid ribs 88 and 90 define a groove 92 which is configured to receive a rigid rib 94 formed upon the planar surface 84 about a grate 96. A recess 98 is formed in a ridge 99 formed about the periphery 102 of the cap 70. The recess 98 receives the distal end of the hinged cover 72 such that it may be disposed in the closed position. A post 80 is formed upon the lower surface 86 of the hinged cover 72. A post detent 82 formed upon the distal end of the post 80 and engages a slot 104 in the grate 96 to lock the cap in the closed position. As in the first embodiment, a lip guard 76 permits sanitary dispensing of the beverage.

Figure 12:
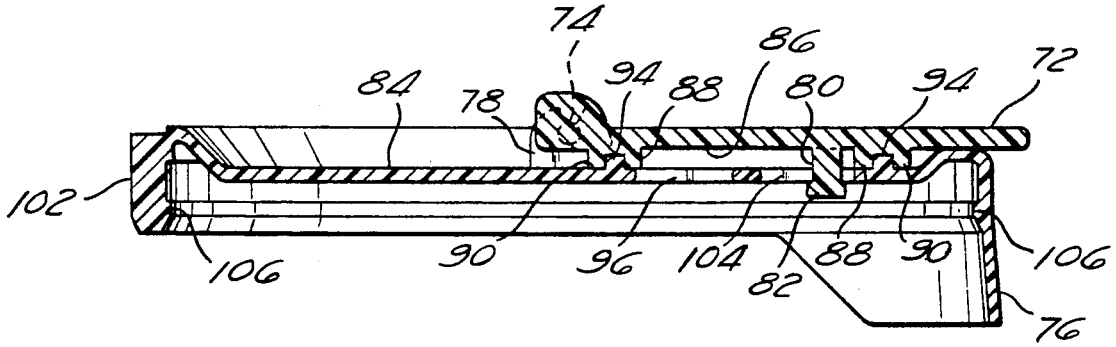
FIG. 12 is a cross-sectional side view of the cap of FIG. 11 showing the cover disposed in the closed position.

Referring now to FIG. 12, engagement of the inner 88 and outer 90 rigid ribs formed upon the underside 86 of the hinged cover 72 with the rib 94 formed upon the planar surface 84 is depicted. Such engagement preferably forms a gas-tight seal to effect containment of the carbonation fizz within a soft drink contained within a container. A detent 106 formed about the periphery 102 preferably likewise provides such a seal to the soft drink container (not shown) as in the first embodiment. With the cover 72 in the closed position, as shown in FIG. 12, the post detent 82 is captured by the grill 96 and thus locks the cover 72 in the closed position.

It is understood that the exemplary protective cap with sealable cover described herein and shown in the drawings represents only a presently preferred embodiment of the invention. Indeed, various modifications and additions may be made to such embodiment without departing from the spirit and scope of the invention. For example, the seal need not be disposed on the hinged cover as illustrated and described, but rather may be disposed in various configurations intermediate the cover end top surface of the cap, e.g. upon the surface of the cap, such that gases are prevented from escaping through the grate when the cover is in the closed position. Also, various detent means are contemplated. Thus, these and other modifications and additions may be obvious to those skilled in he art and may be implemented to adapt the present invention for use in a variety of applications.

What is claimed is:

1. A protective cap for preventing insects, airborne debris, and the like from entering a beverage container, for preventing spillage, and for sealing carbonation within the container, the cap comprising:

(a) a generally planar surface having a peripheral portion formed thereabout, said generally planar surface having an opening formed therein, said generally planar surface removably attachable to a beverage can such that a gas-tight seal is provided at the periphery of said cap between said cap an said can;

(b) a cover hingeably attached to said cap such that said cover can be rotated between an opened position and a closed position of said opening;

(c) a compressible seal disposed intermediate said cover and said generally planar surface when said cover is disposed in a closed position;

(d) a detent means formed upon one of said generally planar surface and said cover for engaging said cover in a closed position such that said seal is sufficiently compressed to provide gas-tight closure, said detent means comprising a first detent formed upon a distal portion of said cover and a second detent formed upon the periphery of said generally planar surface.

2. A protective cap for preventing insects, airborne debris, and the like from entering a beverage container, for preventing spillage, and for sealing carbonation within the container, the cap comprising:

(a) a generally planar surface having a peripheral portion formed thereabout, said generally planar surface having an opening formed therein, said generally planar surface removably attachable to a beverage can such that a gas-tight seal is provided at the periphery of said cap between said cap and said can;

(b) a cover hingeably attached to said cap such that said cover can be rotated between an opened position and a closed position of said opening;

(c) a compressible seal disposed intermediate said cover and said generally planar surface when said cover is disposed in a closed position;

(d) a detent means formed upon one of said generally planar surface and said cover for engaging said cover in a closed position such that said seal is sufficiently compressed to provide a gas-tight closure;

(e) a groove formed in said cover; and (f) wherein a portion of said seal is disposed within said groove.

3. The protective cap as recited in claim 2 further comprising a grate formed within said opening.

4. The protective cap as recited in claim 2 wherein said compressible seal is formed by molding a compressible material directly into said groove.

5. The protective cap as recited in claim 4 wherein:

(a) said groove is defined by a plurality of inner and outer substantially parallel ribs; and (b) said seal comprises a plurality of transverse members extending between said inner and outer ribs.

6. A protective cap for preventing insects, airborne debris, and the like from entering a beverage container, for preventing spillage, and for sealing carbonation within the container, the cap comprising:

(a) a generally planar surface having a peripheral portion formed thereabout, said generally planar surface having an opening formed therein, said generally planar surface removably attachable to a beverage can such that a gas-tight seal is provided at the periphery of said cap between said cap an said can;

(b) a cover hingeably attached to said cap such that said cover can be rotated between an opened position and a closed position of said opening;

(c) a compressible seal disposed intermediate said cover and said generally planar surface when said cover is disposed in a closed position;

(d) a detent means formed upon one of said generally planar surface and said cover for engaging said cover in a closed position such that said seal is sufficiently compressed to provide gas-tight closure;

(e) a groove formed in said cover; and (f) wherein a portion of said seal is disposed within said groove.

7. The protective cap as recited in claim 6 wherein said detent means comprises a first detent formed upon said generally planar surface and a complementary second detent formed upon said cover.

8. A protective cap for preventing insects, airborne debris, and the like from entering a beverage container, for preventing spillage and for sealing carbonation within the container, the cap comprising:

a) a generally planar surface;

b) a peripheral portion formed substantially perpendicular to said generally planar surface at the periphery of said generally planar surface, said peripheral portion having a detent formed thereon for releasably attaching the protective cap to a beverage container and also having a groove formed therein for receiving the upper rim of a soft drink container, said detent cooperating with said groove to form a gas-tight seal between said cap and said can;

c) an opening formed in said generally planar surface;

d) a grate formed within said opening;

e) a cover hingeably attached to said generally planar surface such that said cover can be rotated between an opened position and a closed position, said cover having a groove formed about the periphery of the lower surface thereof;

f) a compressible seal, a portion of said seal disposed within said groove;

g) a first detent formed upon said cover and a complementary second detent formed upon said generally planar surface, said first and second detents to engage said cover in a closed position such that said seal is compressed and a gas-tight closure is formed.

9. A protective cap for preventing insects, air-borne debris, and the like from entering a beverage container, for preventing spillage, and for sealing carbonation within the container, the cap comprising:

(a) a generally planar surface having a peripheral portion formed thereabout, said generally planar surface having an opening formed therein, said generally planar surface removably attachable to a beverage can;

(b) a cover hingeably attached to said cap such that said cover can be rotated between an opened position and a closed position of said opening;

(c) a rigid seal disposed intermediate said cover and said generally planar surface when said cover is disposed in a closed position, said rigid seal comprising at least one rib formed upon said cover and at least one rib formed upon said generally planar surface; and (d) a detent means formed upon at least one of said generally planar surface and said cover for engaging said cover in a closed position.

10. The protective cap as recited in claim 9 further comprising:

(a) a groove formed in said cover; and (b) wherein a portion of said seal is disposed within said groove.

11. The protective cap as recited in claim 10 further comprising a grate formed within said opening.

12. The protective cap as recited in claim 11 wherein said detent means comprises a post formed upon said cover, said post having a detent formed upon the distal end thereof, said post cooperating with said grate to lock said cover in a closed position such that said at least one first rib engages said at least one second rib.

13. A protective cap for preventing insects, air-borne debris, and the like from entering a beverage container, for preventing spillage, and for sealing carbonation within the container, the cap comprising:

(a) a generally planar surface having a peripheral portion formed thereabout, said generally planar surface having an opening formed therein, said generally planar surface removably attachable to a beverage can such that a gas-tight seal is provided at the periphery of said cap between said cap and said can;

(b) a cover having a distal end and being hingeably attached to said cap such that said cover can be rotated between an opened position and a closed position of said opening (c) a compressible seal disposed intermediate said cover and said generally planar surface when said cover is disposed in a closed position;

(d) a detent means formed upon one of said generally planar surface and said cover for engaging said cover in a closed position such that said seal is sufficiently compressed to provide a gas-tight closure, said detent means comprising;

(i) a first detent formed upon the distal portion of said cover; and (ii) a second detent formed upon the periphery of said generally planar surface.

* * * * *